US009299353B2

(12) United States Patent
Sole et al.

(10) Patent No.: US 9,299,353 B2
(45) Date of Patent: Mar. 29, 2016

(54) METHOD AND APPARATUS FOR THREE-DIMENSIONAL ACOUSTIC FIELD ENCODING AND OPTIMAL RECONSTRUCTION

(75) Inventors: Antonio Mateos Sole, Barcelona (ES); Pau Arumi Albo, Barcelona (ES)

(73) Assignee: Dolby International AB, Amsterdam Zuidoost (NL)

( * ) Notice: Subject to any disclaimer, the term of this patent is extended or adjusted under 35 U.S.C. 154(b) by 631 days.

(21) Appl. No.: 13/142,822

(22) PCT Filed: Dec. 29, 2009

(86) PCT No.: PCT/EP2009/009356

§ 371 (c)(1),
(2), (4) Date: Aug. 31, 2011

(87) PCT Pub. No.: WO2010/076040

PCT Pub. Date: Jul. 8, 2010

(65) Prior Publication Data

US 2011/0305344 A1 Dec. 15, 2011

(30) Foreign Application Priority Data

Dec. 30, 2008 (EP) ..... 08382091

(51) Int. Cl.
*G10L 19/008* (2013.01)

(52) U.S. Cl.
CPC ..... *G10L 19/008* (2013.01); *H04S 2420/11* (2013.01)

(58) Field of Classification Search
CPC ..... G10L 19/00; G10L 19/008; G10L 19/02; G10L 19/20; G10L 19/24; H04S 3/00; H04S 3/008; H04S 7/30; H04S 2400/15; H04S 2420/03; H04S 2420/11
USPC ..... 381/17–23; 700/94; 704/500–501
See application file for complete search history.

(56) References Cited

U.S. PATENT DOCUMENTS 6,628,787 B1 9/2003 McGrath et al.
6,718,042 B1 4/2004 McGrath (Continued)

FOREIGN PATENT DOCUMENTS

EP 1 416 769 A 5/2004
RS 1332 8/2013

(Continued)

OTHER PUBLICATIONS

Mariette, N., "Re: [PD] 6 speakers in a circle, ambi? bap?" [online] (Oct. 6, 2008) XP002528223 PD-List retrieved from the internet: URL: http://lists.puredata.info.pipermail/pd-lists/2008-10/065359.html? [retrieved on May 15, 2009].

(Continued)

*Primary Examiner* — Paul McCord
*Assistant Examiner* — Alexander Eljaiek

(57) ABSTRACT

A method and apparatus to encode audio with spatial information in a manner that does not depend on the exhibition setup, and to decode and play out optimally for any given exhibition setup, maximizing the sweet-spot area, and including setups with loudspeakers at different heights, and headphones. The part of the audio that requires very precise localization is encoded into a set of mono tracks with associated directional parameters, whereas the remaining audio is encoded into a set of Ambisonics tracks of a chosen order and mixture. Upon specification of a given exhibition system, the exhibition-independent format is decoded adapting to the specified system, by using different decoding methods for each assigned group.

15 Claims, 11 Drawing Sheets

(56) References Cited

U.S. PATENT DOCUMENTS

| | | | | |
|---|---|---|---|---|
| 7,706,543 | B2 | 4/2010 | Daniel | |
| 7,930,048 | B2 | 4/2011 | Reichelt | |
| 2006/0045275 | A1* | 3/2006 | Daniel | 381/17 |
| 2007/0269063 | A1* | 11/2007 | Goodwin et al. | 381/310 |
| 2008/0004729 | A1* | 1/2008 | Hiipakka | 700/94 |

FOREIGN PATENT DOCUMENTS

| | | | |
|---|---|---|---|
| WO | WO 93/18630 | A | 9/1993 |
| WO | WO 2007/074269 | A | 7/2007 |

OTHER PUBLICATIONS

Vaananen, R., "User interaction and authoring of 3D sound scenes in the carrouso EU project" Audio Engineering Society Convention Paper, New York, NY, US (Mar. 23, 2003).

Mateos, T., "Algorithms for sound rendering" [online] Retrieved from the internet: URL:http://www.20203dmedia.eu/reseources.htm> [retrieved on May 14, 2009].

International Search Report issued in corresponding PCT application No. PCT/EP2009/009356 on Apr. 8, 2010.

Stauss, M., "Mehrkanal-Wiedergabetechniken" Internet Citation [online] XP000962742 Retrieved from the INternet: URL Http://iem.kug.ac.at/{sontacchi/hoat/Wiedergabetechniken%20fuer%mehrkanal.pdf> [retrieved on Jan. 1, 2006].

Stanojevic et al., "Designing TSS Halls", 13th ICCA, Yugoslavia (1989).

Stanojevic et al., "Some Technical Poissibilities of Using the Total Surround Sound Concept in the Motion Picture Technology", 133rd SMPTE Technical Conference and Equipment Exhibit, Los Angeles, CA, Oct. 1991.

Stanojevic et al., "TSS System and Live Performance Sound", 88th AES Convention, Montreux, Mar. 1990.

Stanojevic, "Virtual Sound Sources in the Total Surround Sound System", 137th SMPTE Technical Conference and World Media Expo, New Orleans, LA, Sep. 1995.

Stanojevic, "Surround Sound for a New Generation of Theaters", Sound & Video Contractor, pp. 30-40, Dec. 20, 1995.

Stanojevic et al., "The Total Surround Sound System", 86th AES Convention, Hamburg, Mar. 1989.

Stanojevic et al., "The Total Surround Sound (TSS) Processor", SMPTE Journal, 103:734-740 (1994).

Stanojevic et al., "TSS Processor", 135th SMPTE Technical Conference and Equipment Exhibit, Los Angeles, CA, Oct. 1993.

Stanojevic, "3-D Sound in Future HDTV Projection Systems", 132nd SMPTE Technical Conference and Equipment Exhibit, New York, NY, Oct. 1990.

* cited by examiner

METHOD AND APPARATUS FOR THREE-DIMENSIONAL ACOUSTIC FIELD ENCODING AND OPTIMAL RECONSTRUCTION

CROSS REFERENCE TO RELATED APPLICATIONS

This application is a 35 U.S.C. §371 National Stage of Application No. PCT/EP2009/009356, filed Dec. 29, 2009, which claims the benefit under 35 U.S.C. §119(a) to European Patent Application No. 08382091.0, filed Dec. 30, 2008. The disclosure of each of the prior applications is considered part of and is incorporated by reference in the disclosure of this application.

FIELD OF INVENTION

The present invention relates to techniques to improve three-dimensional acoustic field encoding, distribution and decoding. In particular, the present invention relates to techniques of encoding audio signals with spatial information in a manner that does not depend on the exhibition setup; and to decode optimally for a given exhibition system, either multi-loudspeaker setups or headphones.

BACKGROUND OF INVENTION AND PRIOR ART

In multi-channel reproduction and listening, a listener is generally surrounded by multiple loudspeakers. One general goal in reproduction is to construct an acoustic field in which the listener is capable of perceiving the intended location of the sound sources, for example, the location of a musician in a band. Different loudspeaker setups can create different spatial impressions. For example, standard stereo setups can convincingly recreate the acoustic scene in the space between the two loudspeakers, but fail to that purpose in angles outside the two loudspeakers.

Setups with more loudspeakers surrounding the listener can achieve a better spatial impression in a wider set of angles. For example, one of the most well-known multi-loudspeaker layout standard is the surround 5.1 (ITU-R775-1), consisting of 5 loudspeakers located at azimuths of −30, 0, 30, −110, 110 degrees about the listener, where 0 refers to the frontal direction. However, such setup cannot cope with sounds above the listener's horizontal plane.

To increase the immersive experience of the listener, the present tendency is to exploit many-loudspeaker setups, including loudspeakers at different heights. One example is the 22.2 system developed by Hamasaki at the NHK, Japan, which consists of a total of 24 loudspeakers located at three different heights.

The present paradigm for producing spatialised audio in professional applications for such setups is to provide one audio track for each channel used in reproduction. For example, 2 audio tracks are needed for a stereo setup; 6 audio tracks are needed in a 5.1 setup, etc. These tracks are normally the result of the postproduction stage, although they can also be produced directly in the recording stage for broadcasting. It is worth noticing that in many occasions a few loudspeakers are used to reproduce exactly the same audio channels. This is the case of most 5.1 cinema theatres, where each surround channel is played-back through three or more loudspeakers. Thus, in these occasions, although the number of loudspeakers might be larger than 6, the number of different audio channels is still 6, and there are only 6 different signals played-back in total.

One consequence of this one-track-per-channel paradigm is that it links the work done at the recording and postproduction stages to the exhibition setup where the content is to be exhibited. At the recording stage, for example in broadcasting, the type and position of the microphones used and the way they are mixed is decided as a function of the setups where the event is to be reproduced. Similarly, in media production, postproduction engineers need to know the details of the setup where the content will be exhibited, and then take care of every channel. Failure of correctly setting up the exhibition multi-loudspeaker layout for which the content was tailored will result in a decrease of reproduction quality. If content is to be exhibited in different setups, then different versions need to be created in postproduction. This results in an increase of costs and time consumption.

Another consequence of this one-track-per-channel paradigm is the size of data needed. On the one hand, without further encoding, the paradigm requires as many audio tracks as channels. On the other hand, if different versions are to be provided, they are either provided separately, which again increases the size of the data, or some down-mix needs to be performed, which compromises the resulting quality.

Finally, another downside of the one-track-per-channel paradigm is that content produced in this manner is not future proof. For example, the 6 tracks present in a given film produced for a 5.1 setup do not include audio sources located above the listener, and do not fully exploit setups with loudspeakers at different heights.

Currently, there exist a few technologies capable of providing exhibition system independent spatialised audio. Perhaps the simplest technology is amplitude panning, like the so-called Vector-Based Amplitude Panning (VBAP). It is based on feeding the same mono signal to the loudspeakers that are closer to the position where the sound source is intended to be located, with an adjustment of the volume for each loudspeaker. Such systems can work in 2D or 3D (with height) setups, typically by selecting the two or three closer loudspeakers, respectively. One virtue of this method is that it provides a large sweet-spot, meaning that there is a wide region inside the loudspeakers setup where sound is perceived as incoming from the intended direction. However, this method is neither suitable for reproducing reverberant fields, like those present in reverberant rooms, nor sound sources with a large spread. At most the first rebounds of the sound emitted by the sources can be reproduced with these methods, but it provides a costly low-quality solution.

Ambisonics is another technology capable of providing exhibition system independent spatialised audio. Originated in the 70s by Michael Gerzon, it provides a complete encoding-decoding chain methodology. At encoding, a set of spherical harmonics of the acoustic field at one point are saved. The zeroth order (W) corresponds to what an omnidirectional microphone would record at that point. The first order, consisting of 3 signals (X,Y,Z), corresponds to what three figure-of-eight microphones at that point, aligned with Cartesian axes would record. Higher order signals correspond to what microphones with more complicated patterns would record. There exist mixed order Ambisonics encoding, where only some subsets of the signals of each order are used; for example, by using only the W, X, Y signals in first-order Ambisonics, thus neglecting the Z signal. Although the generation of signals beyond first order is simple in postproduction or via acoustic field simulations, it is more difficult when recording real acoustic fields with microphones; indeed, only microphones capable of measuring zero and first order signals have been available for professional applications until very recently. Examples of first-order Ambisonics microphones are the Soundfield and the more recent TetraMic. At decoding, once the multi-loudspeaker setup is specified (number and position of every loudspeaker), the signal to be fed to each loudspeaker is typically determined by requiring that the acoustic field created by the complete setup approximates as much as possible the intended field (either the one created in postproduction, or the one from where the signals where recorded). Besides exhibition-system independence, further advantages of this technology are the high degree of manipulation that it offers (basically soundscape rotation and zoom), and its capability of faithfully reproducing reverberant field.

However, Ambisonics technology presents two main disadvantages: the incapability to reproduce narrow sound sources, and the small size of the sweet-spot. The concept of narrow or spread sources is used in this context as referring to the angular width of the perceived sound image. The first problem is due to the fact that, even when trying to reproduce a very narrow sound source, Ambisonics decoding turns on more loudspeakers than just the ones closer to the intended position of the source. The second problem is due to the fact that, although at the sweet-spot, the waves coming from every loudspeaker add in phase to create the desired acoustic field, outside the sweet-spot, waves do not interfere with the correct phase. This changes the colouration of sound and, more importantly, sound tends to be perceived as incoming from the loudspeaker closer to the listener due to the well-known psychoacoustical precedence effect. For a fixed size of the listening room, the only way to reduce both problems is to increase the Ambisonics order used, but this implies a rapid growth in the number of channels and loudspeakers involved.

It is worth mentioning that another technology exists capable of exactly reproducing an arbitrary sound field, the so-called Wave Field Synthesis (WFS). However, this technology requires the loudspeakers to be separated less than 15-20 cm, a fact that requires further approximations (and consequent loss of quality) and increases enormously the number of loudspeakers required; present applications use between 100 and 500 loudspeakers, which narrows its applicability to very high-end customized events.

It is desirable to provide a technology capable of providing spatialized audio content that can be distributed independently of the exhibition setup, be it 2D or 3D; which, once the setup is specified, can be decoded to fully exploit its capabilities; which is capable of reproducing all type of acoustic fields (narrow sources, reverberant or diffuse fields) to all listeners within the space, that is, with a large sweet-spot; and which does not require a large number of loudspeakers. This would make it possible to create future-proof content, in the sense that it would easily adapt to all present and future multi-loudspeaker setups, and it would also make it possible for the cinema theatres or home users to choose the multi-loudspeaker setup that best fits their needs and purposes, with the benefit of being sure that there will be plenty of content that will fully exploit the capabilities of their chosen setup.

SUMMARY OF INVENTION

A method and apparatus to encode audio with spatial information in a manner that does not depend on the exhibition setup, and to decode and play out optimally for any given exhibition setup, including setups with loudspeakers at different heights, and headphones.

The invention is based on a method for, given some input audio material, encoding it into an exhibition-independent format by assigning it into two groups: the first group contains the audio that needs highly directional localization; the second group contains audio for which the localization provided by low order Ambisonics technology suffices.

All audio in the first group is to be encoded as a set of separate mono audio tracks with associated metadata. The number of separate mono audio tracks is unlimited, although some limitations can be imposed in certain embodiments, as described below. The metadata is to contain information about the exact moment at which each such audio track is to be played-back, as well as spatial information describing, at least, the direction of origin of the signal at every moment. All audio in the second group is to be encoded into a set of audio tracks representing a given order of Ambisonics signals. Ideally, there is one single set of Ambisonics channels, although more than one can be used in certain embodiments.

In reproduction, once the exhibition system is known, the first group of audio channels is to be decoded for playback using standard panning algorithms that use a small number of loudspeakers about the intended location of the audio source. The second set of audio channels is to be decoded for playback using Ambisonics decoders optimized to the given exhibition system.

This method and apparatus solves the aforementioned problems as described subsequently.

First, it allows the audio recording, postproduction and distribution stages of typical productions to be independent of the setups where content is to be exhibited. One generic consequence of this fact is that content produced with this method is future proof in the sense that it can adapt to any arbitrary multi-loudspeaker setup, either present or future. This property is also fulfilled by Ambisonics technology.

Second, it is capable of correctly reproducing very narrow sources. These are encoded into individual audio tracks with associated directional metadata, allowing for decoding algorithms that use a small number of loudspeakers about the intended location of the audio source, like 2D or 3D vector based amplitude panning. In contrast, Ambisonics requires the use of high orders to achieve the same result, with the associated increase of number of associated tracks, data and decoding complexity.

Third, this method and apparatus are capable of providing a large sweet-spot in most situations, thus enlarging the area of optimal soundfield reconstruction. This is accomplished by separating into the first group of audio tracks all parts of audio that would be responsible for a reduction of the sweet-spot. For example, in the embodiment illustrated in FIG. 8 and described below, the direct sound of a dialogue is encoded as a separated audio track with information about its incoming direction, whereas the reverberant part is encoded as a set of first order Ambisonics tracks. Thus, most of the audience perceives the direct sound of this source as arriving from the correct location, mostly from a few loudspeakers about the intended direction; thus, out-of-phase colouration and precedence effects are eliminated from the direct sound, which sticks the sound image at its correct position.

Fourth, the amount of data encoded by using this method is reduced in most situations of multi-loudspeaker audio encoding, when compared to the one-track-per-channel paradigm, and to higher order Ambisonics encoding. This fact is advantageous for storage and distribution purposes. The reason for this data size reduction is twofold. On the one hand, the assignment of the highly directional audio to the narrow-audio playlist allows the use of only first order Ambisonics for reconstruction of the remaining part of the soundscape, which consists of spread, diffuse or non highly directional audio. Thus, the 4 tracks of the first order Ambisonics group suffice. In contrast, higher order Ambisonics would be needed to correctly reconstruct narrow sources, which would require, for example, 16 audio channels for 3rd order, or 25 for 4th order. On the other hand, the number of narrow sources required to play simultaneously is low in many situations; this is the case, for example, of cinema, where only dialogues and a few special sound effects would typically be assigned to the narrow-audio playlist. Furthermore, all audio in the narrow-audio playlist group is a set of individual tracks with length corresponding only to the duration of that audio source. For example, the audio corresponding to a car appearing three seconds in one scene only lasts three seconds. Therefore, in an example of cinema application where the soundtrack of a film for a 22.2 setup is to be produced, the one-track-per-channel paradigm would require 24 audio tracks, and a 3rd order Ambisonics encoding would require 16 audio tracks. In contrast, in the proposed exhibition-independent format it would require only 4 audio tracks with full length, plus a set of separate audio tracks with different lengths, which are minimized in order to only cover the intended duration of the selected narrow sound sources.

DETAILED DESCRIPTION OF PREFERRED EMBODIMENTS

Figure 1:
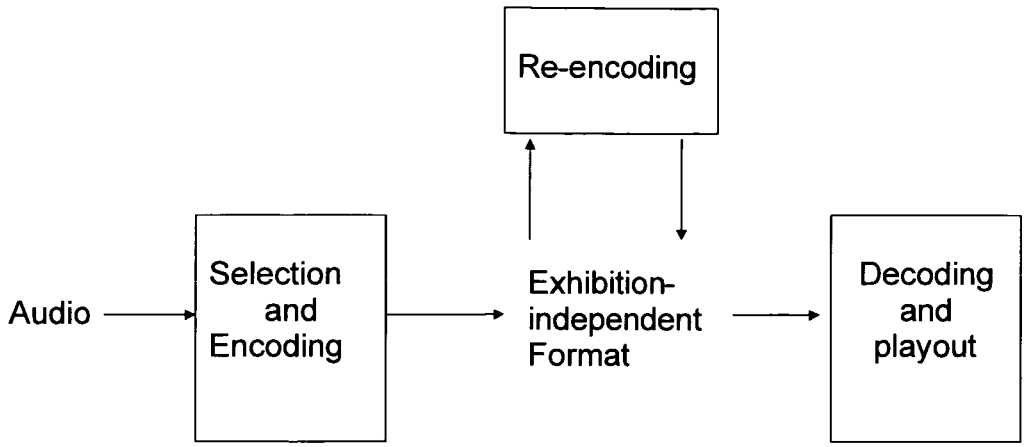
FIG. 1 shows an embodiment of the method for, given a set of initial audio tracks, selecting and encoding them, and finally decoding and playing back optimally in an arbitrary exhibition setup.

FIG. 1 shows an embodiment of the method for, given a set of initial audio tracks, selecting and encoding them, and finally decoding and playing back optimally in an arbitrary exhibition setup. That is, for given loudspeakers locations, the spatial sound field will be reconstructed as well as possible, fitting the available loudspeakers, and enlarging the sweet-spot as much as possible. The initial audio can arise from any source, for example: by the use of any type of microphones of any directivity pattern or frequency response; by the use of Ambisonics microphones capable of delivering a set of Ambisonics signals of any order or mixed order; or by the use of synthetically generated audio, or effects like room reverberation.

The selection and encoding process consists of generating two groups of tracks out of the initial audio. The first group consists of those parts of the audio that require narrow localization, whereas the second group consists of the rest of the audio, for which the directionality of a given Ambisonics order suffices. Audio signals assigned to the first group are kept in mono audio tracks accompanied with spatial metadata about its direction of origin along time, and its initial playback time.

The selection is a user-driven process, though default actions can be taken on some types of initial audio. In the general case (i.e. for non-Ambisonics audio tracks) the user defines for each piece of initial audio, its source direction and the type of source: narrow source or Ambisonics source, corresponding to the aforementioned encoding groups. The direction angles can be defined by, for example, azimuth and elevation of the source with respect to the listener, and can be either specified as fixed values per track or as time-varying data. If no direction is provided for some of the tracks, default assignments can be defined, for example, by assigning such tracks to a given fixed constant direction.

Optionally, the direction angles can be accompanied with a spread parameter. The terms spread and narrow are to be understood in this context as the angular width of the perceived sound image of the source. For example, a way to quantify spread is using values in the interval [0,1], wherein a value of 0 describes perfectly directional sound (that is, sound emanating from one distinguishable direction only), and a value of 1 describes sound arriving from all directions with the same energy.

For some types of initial tracks, default actions can be defined. For example, tracks identified as stereo pairs, can be assigned to the Ambisonics group with an azimuth of −30 and 30 degrees for the L and R channels respectively. Tracks identified as surround 5.1 (ITU-R775-1) can be similarly mapped to azimuths of −30, 0, 30, −110, 110 degrees. Finally, tracks identified as first order Ambisonics (or B-format), can be assigned to the Ambisonics group without needing further direction information.

Figure 2:
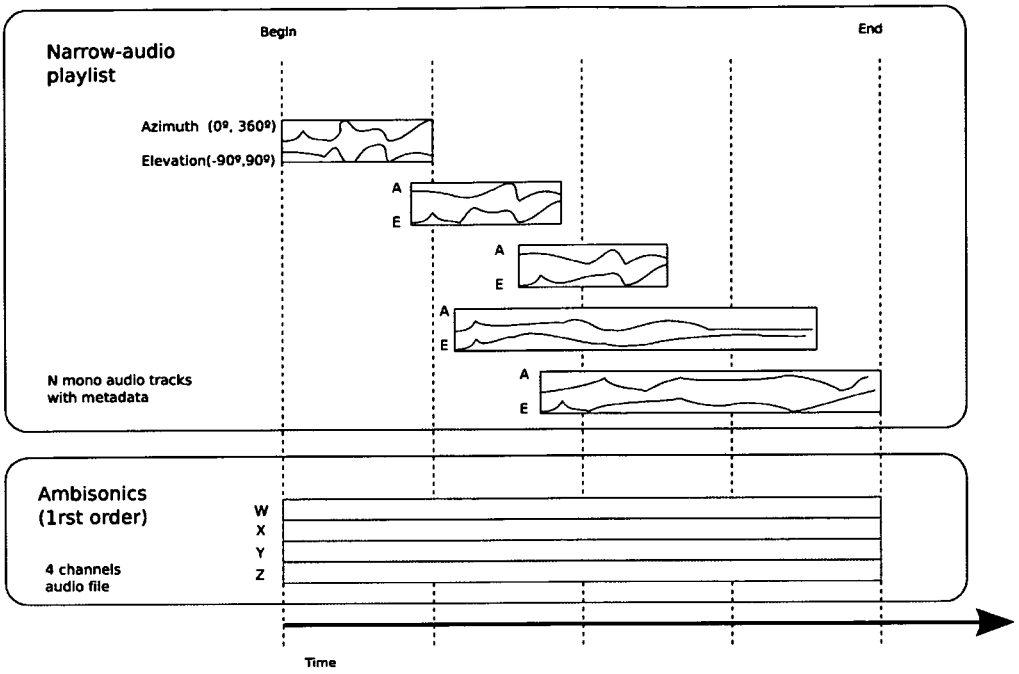
FIG. 2 shows a scheme of the proposed exhibition-independent format, with the two groups of audio: the narrow-audio playlist with spatial information and the Ambisonics tracks.

The encoding process of FIG. 1, takes the aforementioned user-defined information and outputs an exhibition-independent audio format with spatial information, as described in FIG. 2 The output of the encoding process for the first group is a set of mono audio tracks with audio signals corresponding to different sound sources, with associated spatial metadata, including the direction of origin with respect to a given reference system, or the spread properties of the audio. The output of the conversion process for the second group of audio is one single set of Ambisonics tracks of a chosen order (for example, 4 tracks if first order Ambisonics is chosen) which corresponds to the mix of all the sources in the Ambisonics group.

The output of the encoding process is then used by a decoder which uses information about the chosen exhibition setup to produce one audio track or audio stream for each channel of the setup.

Figure 3:
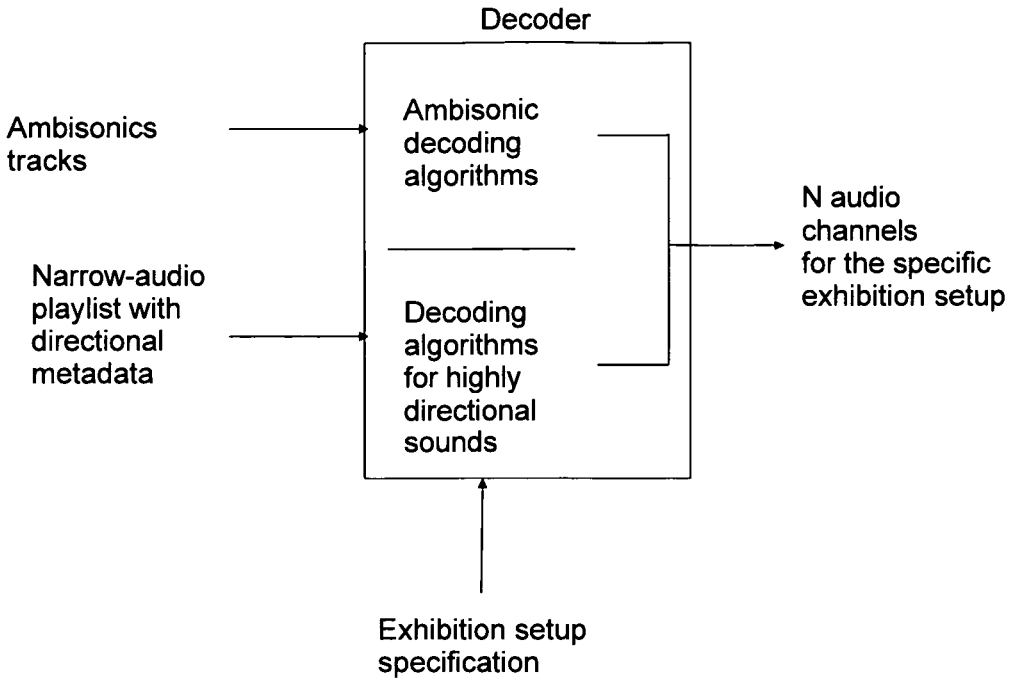
FIG. 3 shows a decoder that uses different algorithms to process either group of audio.

FIG. 3 shows a decoder that uses different algorithms to process either group of audio. The group of Ambisonics tracks is decoded using suitable Ambisonics decoders for the specific setup. The tracks in the narrow-audio playlist are decoded using algorithms suited for this purpose; these use each track metadata spatial information to decode, normally, using a very small number of loudspeakers about the intended location of each track. One example of such an algorithm is Vector-Based Amplitude Panning. The time metadata is used to start the playback of each such audio at the correct moment. The decoded channels are finally sent for playback to the loudspeakers or headphones.

Figure 4:
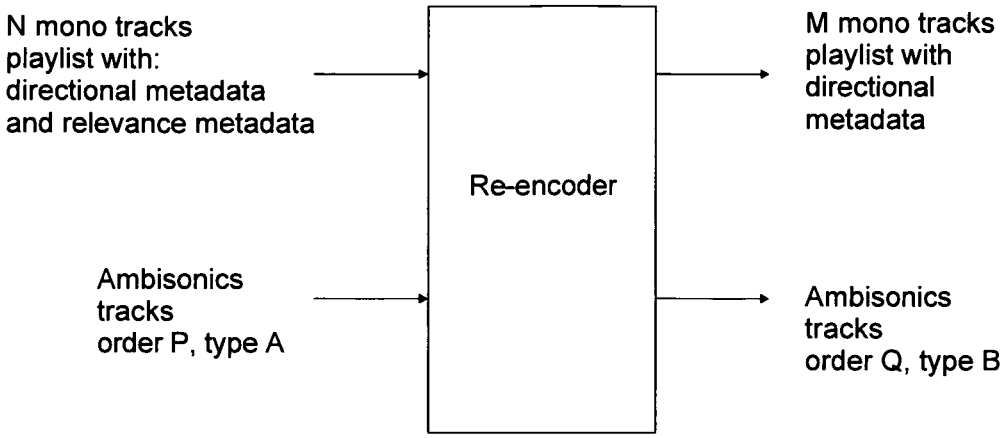
FIG. 4 shows an embodiment of a method by which the two groups of audio can be re-encoded.

FIG. 4 shows a further embodiment of a method by which the two groups of audio can be re-encoded. The generic re-encoding process takes as input a narrow-audio playlist which contains N different audio tracks with associated directional metadata, and a set of Ambisonics tracks of a given order P, and a given type of mixture A (for example, it could contain all tracks at zeroth and first order, but only 2 tracks corresponding to second order signals). The output of the re-encoding process is a narrow-audio playlist which contains M different audio tracks with associated directional metadata, and a set of Ambisonics tracks of a given order Q, with a given type of mixture B. In the re-encoding process, M, Q, B can be different from N, P, A, respectively.

Re-encoding might be used, for example, to reduce the number of data contained. This can be achieved, for example, by selecting one or more audio tracks contained in the narrow-audio playlist and assigning them to the Ambisonics group, by means of a mono to Ambisonics conversion that makes use of the directional information associated to the mono track. In this case, it is possible to obtain M<N at the expense of using Ambisonics localization for the re-encoded narrow audio. With the same aim, it is possible to reduce the number of Ambisonics tracks, for example, by retaining only those that are required to play-back in planar exhibition setups. Whereas the number of Ambisonics signals for a given or P is (P+1)2, the reduction to planar setups reduces the number to 1+2 P.

Another application of the re-encoding process is the reduction of simultaneous audio tracks required by a given narrow-audio playlist. For example, in broadcasting applications it might be desirable to limit the number of audio tracks that can play simultaneously. Again, this can be solved by assigning some tracks of the narrow-audio playlist to the Ambisonics group.

Optionally, the narrow-audio playlist can contain metadata describing the relevance of the audio it contains, which is, a description of how important it is for each audio to be decoded using algorithms for narrow sources. This metadata can be used to automatically assign the least relevant audio to the Ambisonics group.

An alternative use of the re-encoding process might be simply to allow the user to assign audio in the narrow-audio playlist to the Ambisonics group, or to change the order and mixture type of the Ambisonics group just for aesthetic purposes. It is also possible to assign audio from the Ambisonics group to the narrow-audio playlist: one possibility is to select only a part of the zero order track and manually associate its spatial metadata; another possibility is to use algorithms that deduce the location of the source from the Ambisonics tracks, like the DirAC algorithm.

Figure 5:
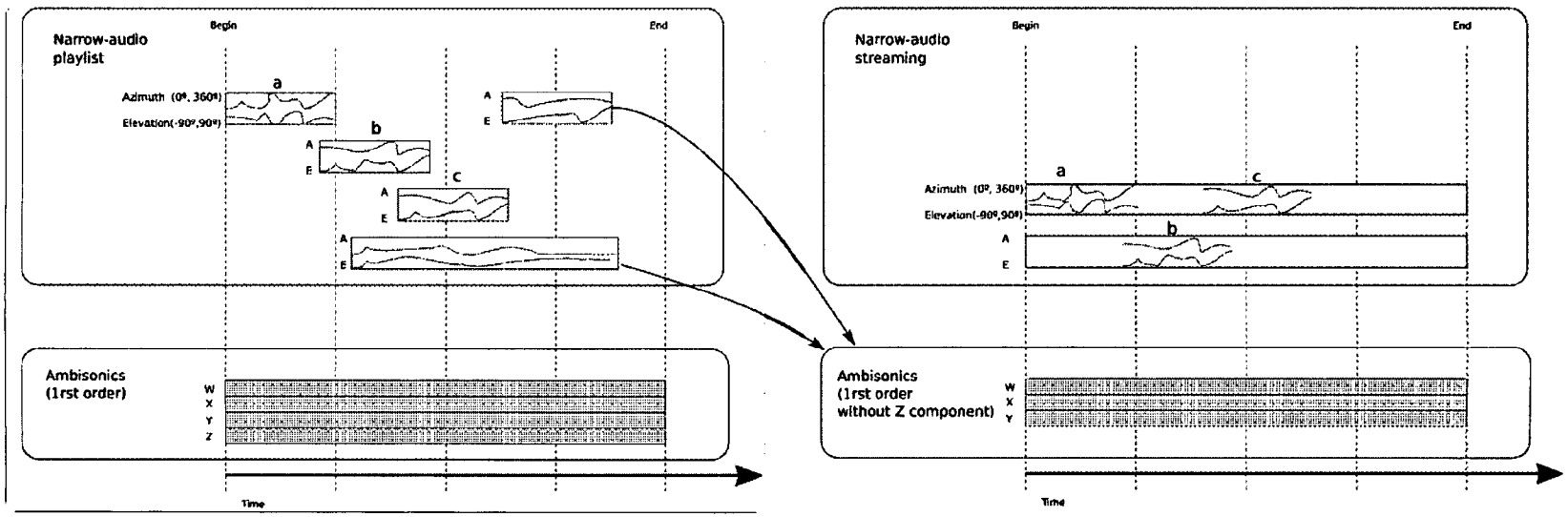
FIG. 5 shows an embodiment whereby the exhibition-independent format can be based on audio streams instead of complete audio files stored in disk or other kinds of memory.

FIG. 5 shows a further embodiment of the present invention, whereby the proposed exhibition-independent format can be based on audio streams instead of complete audio files stored in disk or other kinds of memory. In broadcasting scenarios the audio bandwidth is limited and fixed, and thus the number of audio channels that can be simultaneous streamed. The proposed method consists, first, in splitting the available audio streams between two groups, the narrow-audio streams and the Ambisonics streams and, second, re-encoding the intermediate file-based exhibition-independent format to the limited number of streams.

Such re-encoding uses the techniques explained in the previous paragraphs, to reduce when needed, the number of simultaneous tracks for both the narrow-audio part (by reassigning low relevance tracks to the Ambisonics group) and the Ambisonics part (by removing Ambisonics components).

Audio streaming has further specificities, like the need to concatenate the narrow-audio tracks in continuous streams, and to re-encode the narrow-audio direction metadata in the available streaming facilities. If the audio streaming format does not allow streaming such directional metadata, a single audio track should be reserved to transport this metadata encoded in a proper way.

The following simple example shall serve to explain this in more detail. Consider a movie soundtrack in the proposed exhibition-independent format, using first order Ambisonics (4 channels) and a narrow-audio playlist with a maximum of 4 simultaneous channels. This soundtrack is to be streamed using only 6 channels of digital TV. As depicted in FIG. 5, the re-encoding uses 3 Ambisonics channels (removing the Z channel) and 2 narrow-audio channels (that is, reassigning a maximum of two simultaneous tracks to the Ambisonics group).

Optionally, the proposed exhibition-independent format can make use of compressed audio data. This can be used in both flavours of the proposed exhibition-independent format: file-based or stream-based. When psychoacoustic-based lossy formats are used, the compression might affect the spatial reconstruction quality.

Figure 6:
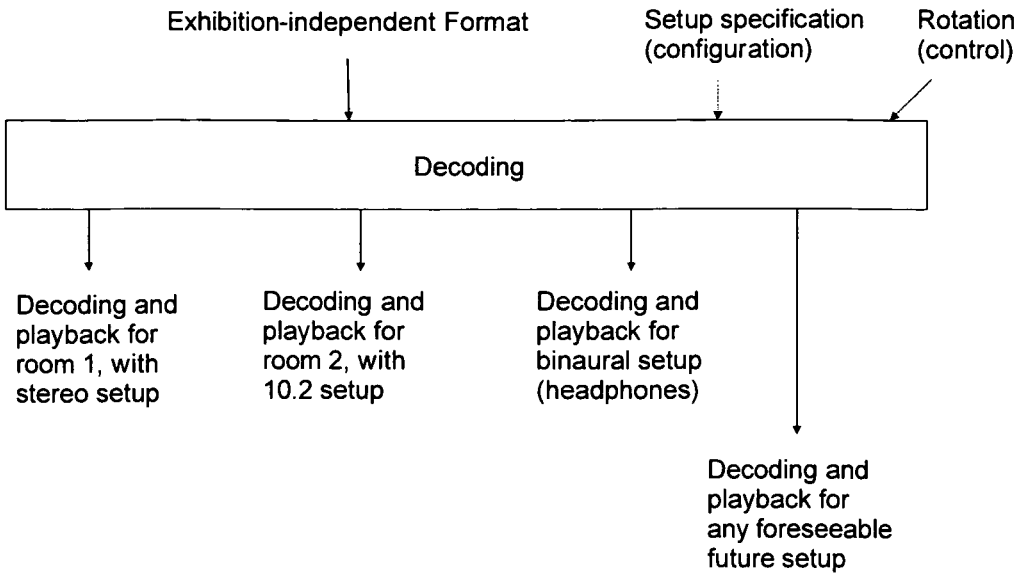
FIG. 6 shows a further embodiment of the method, where the exhibition-independent format is input to a decoder, which is able to reproduce the content in any exhibition setup.

FIG. 6 shows a further embodiment of the method, where the exhibition-independent format is input to a decoder which is able to reproduce the content in any exhibition setup. The specification of the exhibition setup can be done in a number of different ways. The decoder can have standard pre-sets, like surround 5.1 (ITU-R775-1), that the user can simply select to match his exhibition setup. This selection can optionally allow for some adjustment to fine-tune the position of the loudspeakers in the user's specific configuration. Optionally, the user might use some auto-detection system capable of localizing the position of each loudspeaker, for example, by means of audio, ultrasounds or infrared technology. The exhibition setup specification can be reconfigured an unlimited number of times allowing the user to adapt to any present and future multi-loudspeaker setup. The decoder can have multiple outputs so that different decoding processes can be done at the same time for simultaneous play-back in different setups. Ideally, the decoding is performed before any possible equalization of the play-out system.

If the reproduction system is headphones, decoding is to be done by means of standard binaural technology. Using one or various databases of Head-Related Transfer Functions (HRTF) it is possible to produce spatialised sound using algorithms adapted to both groups of audio proposed in the present method: narrow-audio playlists and Ambisonics tracks. This is normally accomplished by first decoding to a virtual multi-loudspeaker setup using the algorithms described above, and then convolving each channel with the HRTF corresponding to the location of the virtual loudspeaker.

Either for exhibition to multi-loudspeaker setups or to headphones, one further embodiment of the method allows for a final rotation of the whole soundscape at the exhibition stage. This can be useful in a number of ways. In one application, a user with headphones can have a head-tracking mechanism that measures parameters about the orientation of their head to rotate the whole soundscape accordingly.

Figure 7:
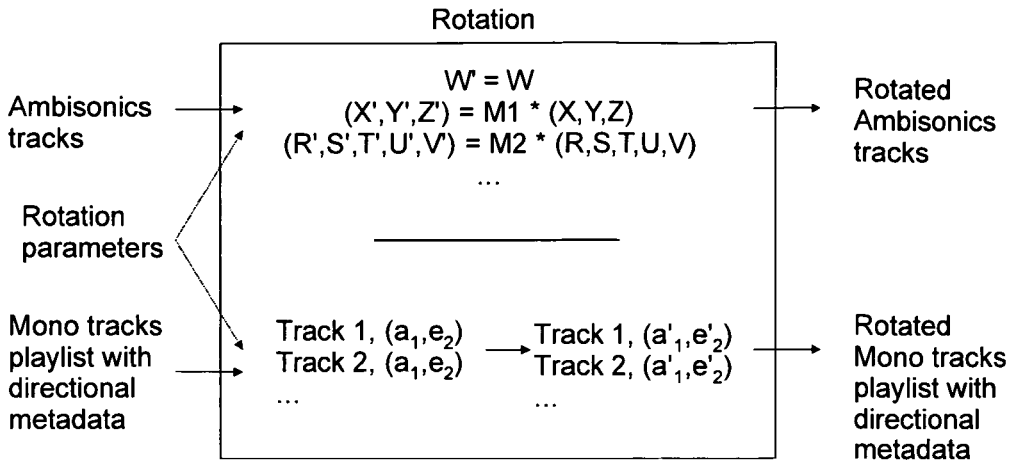
FIG. 7 shows some technical details about the rotation process, which corresponds to simple operations on both groups of audio.

FIG. 7 shows some technical details about the rotation process, which corresponds to simple operations on both groups of audio. The rotation of the Ambisonics tracks is performed by applying different rotation matrices to every Ambisonics order. This is a well-known procedure. On the other hand, the spatial metadata associated to each track in the narrow-audio playlist can be modified by simply computing the source azimuth and elevation that a listener with a given orientation would perceive. This is, again, a simple standard computation.

Figure 8:
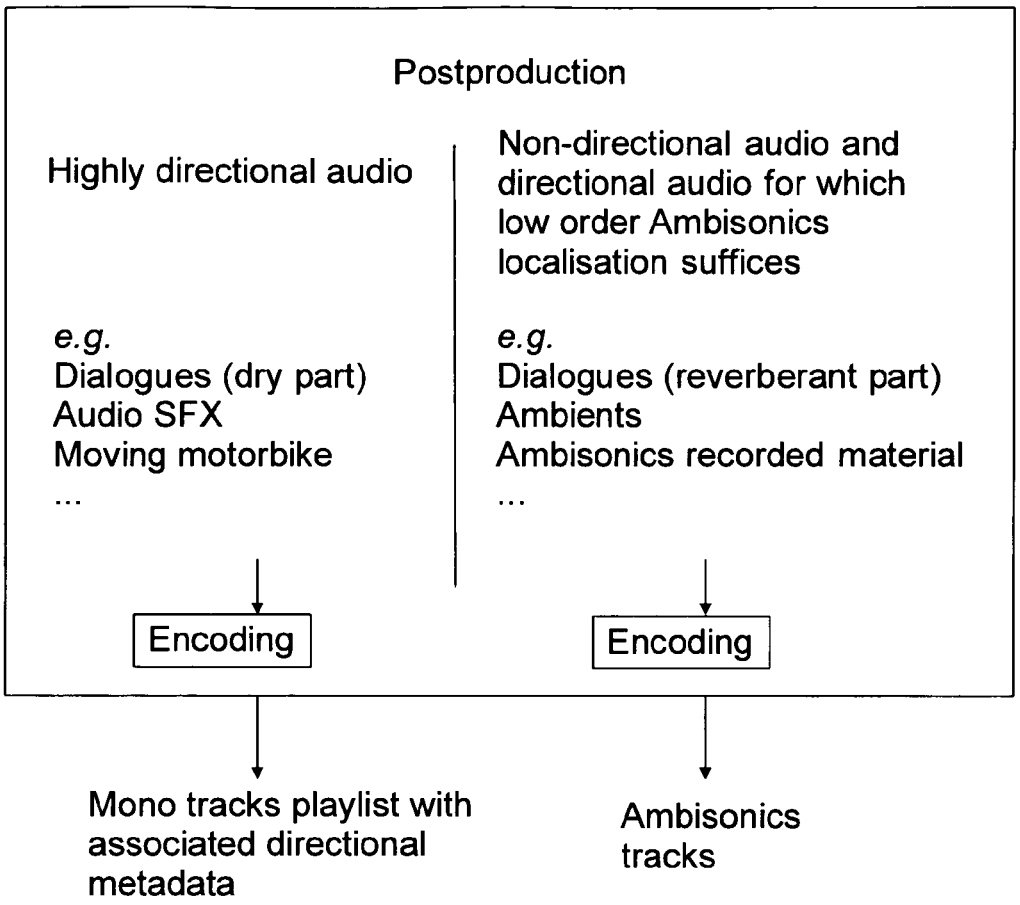
FIG. 8 shows an embodiment of the method in an audio-visual postproduction framework.

FIG. 8 shows an embodiment of the method in an audio-visual postproduction framework. A user has all the audio content in its postproduction software, which can be a Digital Audio Workstation. The user specifies the direction of each source that needs localization either using standard or dedicated plug-ins. To generate the proposed intermediate exhibition-independent format, it selects the audio that will be encoded in the mono tracks playlist, and the audio that will be encoded in the Ambisonics group. This assignment can be done in different ways. In one embodiment, the user assigns via a plug-in a directionality coefficient to each audio source; this is then used to automatically assign all sources with directionality coefficient above a given value to the narrow-audio playlist, and the rest to the Ambisonics group. In an alternative embodiment, some default assignments are performed by the software; for example, the reverberant part of all audio, as well as all audio that was originally recorded using Ambisonics microphones, can be assigned to the Ambisonics group unless otherwise stated by the user. Alternatively, all assignments are done manually.

When the assignments are finished, the software uses dedicated plug-ins to generate the narrow-audio playlist and the Ambisonics tracks. In this procedure, the metadata about the spatial properties of the narrow-audio playlist are encoded. Similarly, the direction, and optionally the spread, of the audio sources that are assigned to the Ambisonics group is used to transform from mono or stereo to Ambisonics via standard algorithms. Therefore the output of the audio post-production stage is an intermediate exhibition-independent format with the narrow-audio playlist and a set of Ambisonics channels of a given order and mixture.

In this embodiment, it can be useful for future re-versioning to generate more than one set of Ambisonics channels. For example, if different language versions of the same movie are to be produced, it is useful to encode in a second set of Ambisonics tracks all the audio related to dialogues, including the reverberant part of dialogues. Using this method, the only changes needed to produce a version in a different language consist of replacing the dry dialogues contained in the narrow-audio playlist, and the reverberant part of the dialogues contained in the second set of Ambisonics tracks.

Figure 9:
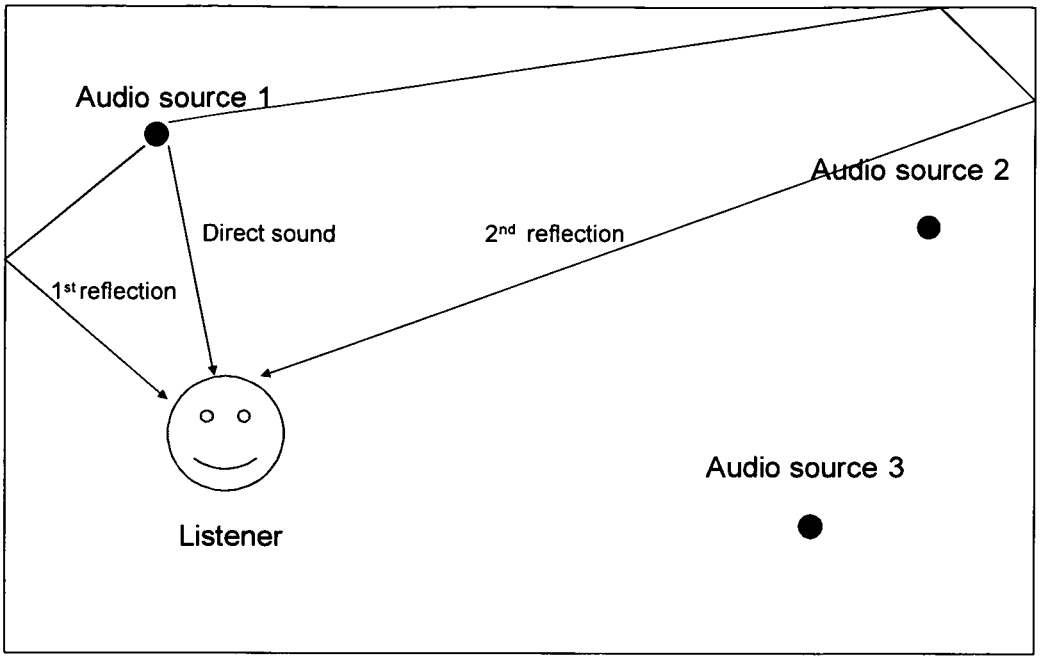
FIG. 9 shows a further embodiment of the method, as part of the audio production and postproduction in a virtual scene (for example, in an animation movie or 3D game).

FIG. 9 shows a further embodiment of the method, as part of the audio production and postproduction in a virtual scene (for example, in an animation movie or 3D game). Within the virtual scene, information is available about the location and orientation of the sound sources and the listener. Information can optionally be available about the 3D geometry of the scene, as well as the materials present in it. The reverberation can be optionally computed automatically by using room acoustics simulations. Within this context, the encoding of the soundscape into the intermediate exhibition-independent format proposed here can be simplified. On one hand, it is possible to assign audio tracks to each source, and encode the position with respect to the listener at each moment by simply deducing it automatically from the respective positions and orientations, instead of having to be specify it later in post-production. It is also possible to decide how much reverberation is encoded in the Ambisonics group, by assigning the direct sound of each source, as well as a certain number of first sound reflections to the narrow-audio playlist, and the remaining part of the reverberation to the Ambisonics group.

Figure 10:
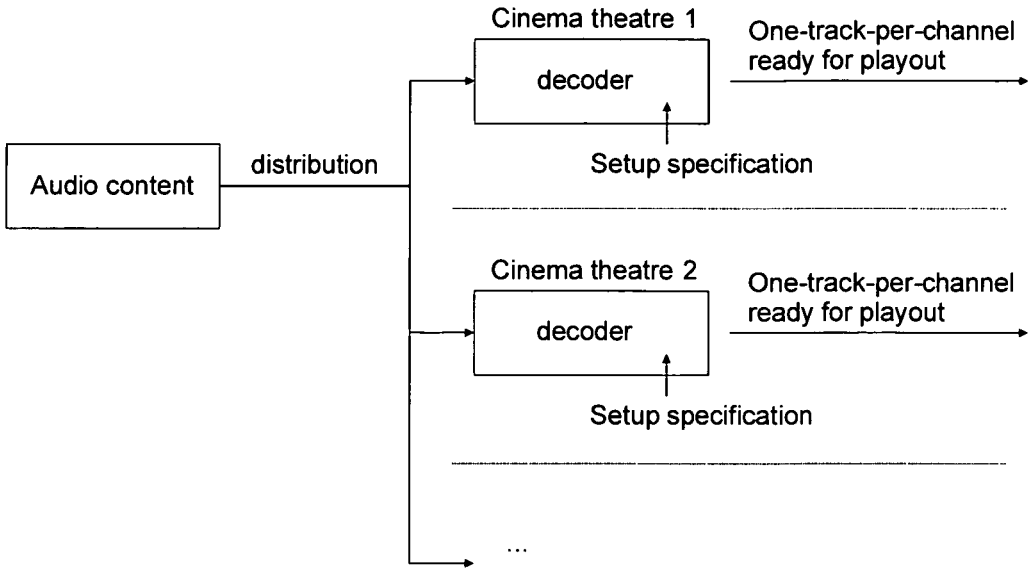
FIG. 10 shows a further embodiment of the method as part of a digital cinema server.

FIG. 10 shows a further embodiment of the method as part of a digital cinema server. In this case, the same audio content can be distributed to the cinema theatres in the described exhibition-independent format, consisting of the narrow-audio playlist plus the set of Ambisonics tracks. Every theatre can have a decoder with the specification of each particular multi-loudspeaker setup, which can be input manually or by some sort of auto-detection mechanism. In particular, the automatic detection of the setup can easily be embedded in a system that, at the same time, computes the equalization needed for every loudspeaker. This step could consist of measuring the impulse response of every loudspeaker in a given theatre to deduce both the loudspeaker position and the inverse filter needed to equalize it. The measurement of the impulse response, which can be done using multiple existing techniques (like sine sweeps, MLS sequences) and the corresponding deduction of loudspeaker positions is a procedure that needs not be done often, but rather only when the characteristics of the space or the setup change. In any case, once the decoder has the specification of the setup, then content can be optimally decoded into a one-track-per-channel format, ready for playback.

Figure 11:
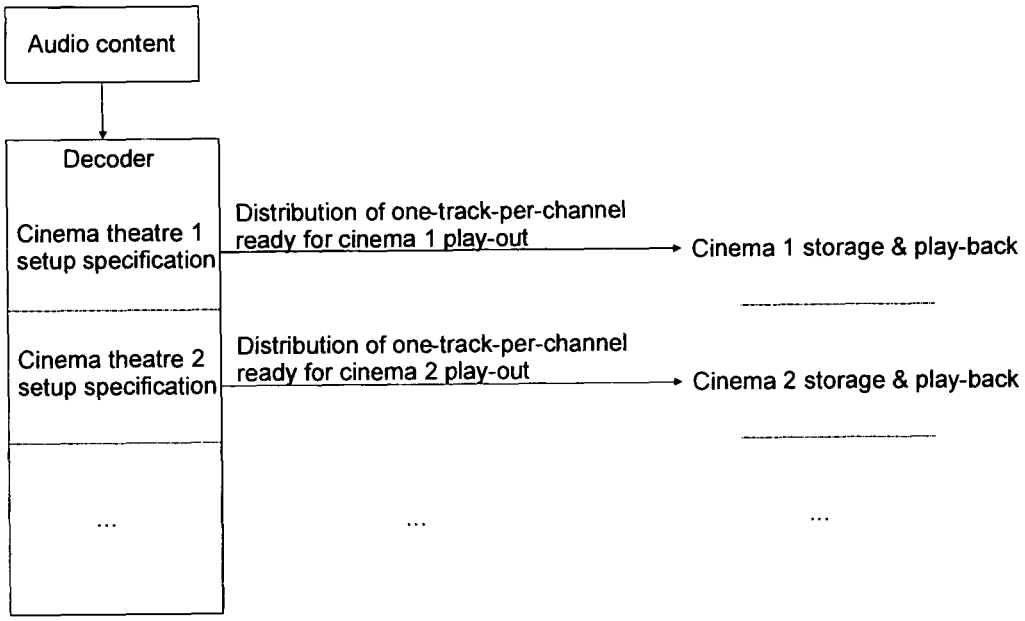
FIG. 11 shows an alternative embodiment of the method for cinema, whereby the content can be decoded before distribution.

FIG. 11 shows an alternative embodiment of the method for cinema, whereby the content can be decoded before distribution. In this case, the decoder needs to know the specification of each cinema setup, so that multiple one-track-per-channel versions of the content can be generated, and then distributed. This application is useful, for example, to deliver content to theatres that do not have a decoder compatible with the exhibition-independent format proposed here. It might also be useful to check or certify the quality of the audio adapted to a specific setup before distributing it.

In a further embodiment of the method, some of the narrow-audio playlist can be re-edited without having to resort to the original master project. For example, some of the metadata describing the position of the sources or their spread can be modified.

While the foregoing has been particularly shown and described with reference to particular embodiments thereof, it will be understood by those skilled in the art that various other changes in form and details may be made without departing from the spirit and scope thereof. It is to be understood that various changes may be made in adapting to different embodiments without departing from the broader concepts disclosed herein and comprehended by the claims that follow.

The invention claimed is:

1. A method for encoding initial audio signals and related spatial information into a reproduction layout-independent format, the initial audio signals arising from any source of a plurality of sources, the method comprising:

defining a threshold directionality value to assign to one of a first group and a second group of one or more sources of the plurality of sources requiring localization;

assigning a directionality coefficient to each source of the one or more sources;

grouping sources with a directionality coefficient above the threshold value to the first group, wherein the first group of sources generate a first set of tracks of audio signals that require narrow localization and encoding the first group only as a set of mono audio tracks with associated metadata describing the direction of origin of the signal of each track with respect to a recording position, and its initial playback time;

encoding individual audio tracks of the first group with the associated metadata to facilitate playback through a minimal number of loudspeakers about an intended location of each respective source of the first group;

grouping sources with a directionality coefficient equal to or below the threshold value to the second group, wherein the second group sources generate a second set of tracks of audio signals that do not require narrow localization and encoding the second group as at least one set of Ambisonics tracks of a given order and mixture of orders; and encoding in the metadata, spread parameters associated to each source of the first group, wherein a value between 0 and 1 describes an angular width of a recorded sound image of the first group.

2. The method of claim 1, further comprising: encoding further directional parameters associated to the tracks in the set of mono audio tracks.

3. The method of claim 1, further comprising: deriving the direction of origin of the signals of the tracks in the first set of tracks from any three-dimensional representation of the scene containing the sound sources associated to the tracks, and the recording location.

4. The method of claim 1, further comprising: assigning the direction of origin of the signals of the tracks in the first set according to predefined rules.

5. The method of claim 1, further comprising: encoding directional parameters for each track in the first set either as fixed constant values, or as time-varying values.

6. The method of claim 1, further comprising: encoding metadata describing the specification of the Ambisonics format used, the metadata comprising one of Ambisonics order, type of mixture of orders, track-related gains, and track-ordering.

7. The method of claim 1, further comprising: encoding the initial play-back time associated to the Ambisonics tracks.

8. The method of claim 1, further comprising: encoding input mono signals with associated directional data into the Ambisonics tracks of a given order and mixture of orders.

9. The method of claim 1, further comprising: encoding any input multichannel signals into the Ambisonics tracks of a given order and mixture of orders.

10. The method of claim 1, further comprising: encoding any input Ambisonics signals, of any order and mixture of orders, into Ambisonics tracks of a possibly different given order and mixture of orders.

11. The method of claim 1 by which all or parts of the audio signals are encoded in compressed audio formats.

12. An audio encoder for encoding initial audio signals and related spatial information into a reproduction layout-independent format, the initial audio arising from any source, the encoder being adapted for:

defining a threshold directionality value to assign to one of a first group and a second group of one or more sources of the plurality of sources requiring localization;

assigning a directionality coefficient to each source of the one or more sources;

grouping sources with a directionality coefficient above the threshold value to the first group, wherein the first group of sources generate a first set of tracks of audio signals that require narrow localization and encoding the first group only as a set of mono audio tracks with associated metadata describing the direction of origin of the signal of each track with respect to a recording position, and its initial playback time;

encoding individual audio tracks of the first group with the associated metadata to facilitate playback through a minimal number of loudspeakers about an intended location of each respective source of the first group;

grouping sources with a directionality coefficient equal to or below the threshold value to the second group, wherein the second group sources generate a second set of tracks of audio signals that do not require narrow localization and encoding the second group as at least one set of Ambisonics tracks of a given order and mixture of orders; and encoding in the metadata, spread parameters associated to each source of the first group, wherein a value between 0 and 1 describes an angular width of a recorded sound image of the first group.

13. A non-transitory computer-readable medium that contains instructions that when executed on a processor cause a computer to perform the method of claim 1.

14. The method of claim 1 wherein the assigning step is performed by an automatic process, and wherein sources of audio signals having reverberant properties are automatically assigned to the first group and audio signals recorded with Ambisonics microphones are automatically assigned to the second group.

15. The method of claim 1 wherein the assigning step is performed manually by a user through audiovisual postproduction tools.

* * * * *